United States Patent [19]

Yokoyama et al.

[11] Patent Number: 4,719,883

[45] Date of Patent: Jan. 19, 1988

[54] DISTRIBUTOR

[75] Inventors: Toshio Yokoyama; Iwao Shimane, both of Saitama, Japan

[73] Assignee: Honda Giken Kogyo Kabushiki Kaisha, Tokyo, Japan

[21] Appl. No.: 39,008

[22] Filed: Apr. 15, 1987

[30] Foreign Application Priority Data

Apr. 15, 1986 [JP] Japan ..... 61-86785

[51] Int. Cl.[4] ..... F02P 7/02; H01R 39/00

[52] U.S. Cl. ..... 123/146.5 A; 123/617; 200/19 DC; 200/19 M

[58] Field of Search ..... 123/146.54, 414, 617; 200/19 R, 19 DC, 19 M

[56] References Cited

U.S. PATENT DOCUMENTS

| | | | |
|---|---|---|---|
| 2,207,378 | 7/1940 | Arthur | 123/146.5 A |
| 3,336,457 | 8/1967 | Julian | 200/19 DC |
| 4,281,627 | 8/1981 | Sakurai | 123/146.5 A |
| 4,348,993 | 9/1982 | Ueno et al. | 123/146.5 A |
| 4,512,296 | 4/1985 | Herrington et al. | 123/146.5 A X |

FOREIGN PATENT DOCUMENTS

| | | | |
|---|---|---|---|
| 19044 | 8/1969 | Japan | 123/146.5 A |
| 4869 | 1/1986 | Japan | 123/146.5 A |

*Primary Examiner*—Tony M. Argenbright
*Attorney, Agent, or Firm*—Lyon & Lyon

[57] ABSTRACT

A distributor accommodates an angle-of-rotation sensor having a magnetic rotating member which is provided to detect the crank angles in an internal combustion engine. The air vent of the distributor is provided with a magnetic trap means that collects any ferrous particles and other such dust in air drawn into the distributor from the outside, preventing such particles adhering to the magnetic rotating member and producing otherwise detection output errors.

4 Claims, 3 Drawing Figures

DISTRIBUTOR

BACKGROUND OF THE INVENTION

1. Field of the Invention

This invention relates to a distributor, and more specifically to structural improvements in a distributor which accommodates an angle-of-rotation sensor provided with a magnetic rotating member for detecting angles of rotation of a crankshaft in an internal combustion engine.

2. Description of the Prior Art

Recently, electronic control technology for internal combustion engines has been making rapid progress. With respect to such electronic control, control timing is important and as such it is necessary to detect with precision piston crank angle positions for use as reference signals. Conventional types of angle-of-rotation sensors include, for example, the type disclosed in Japanese Laid-open Patent Publication No. 57(1982)-133311. In this conventional technology a magnetic rotating member is formed by stacking three disk-shaped magnets one on top of the other.

This type of angle-of-rotation sensor is usually accommodated in a distributor, but when the distributor is equipped with an air vent, there is a risk that particles such as of dust and metal, and foreign matter, may enter the distributor via the air vent and adhere to the magnetic rotating member of the sensor, thereby causing changes in the magnetic characteristics of the rotating member that render accurate detection of crank angles impossible.

SUMMARY OF THE INVENTION

An object of this invention is to provide a distributor which, when used to accommodate an angle-of-rotation sensor provided with a magnetic rotating member, effectively prevents particles entering via the air vent.

To attain the aforesaid objective, the present invention provides a distributor in which is accommodated a magnetic rotating member which rotates in synchronization with the rotation of the crankshaft of an internal combustion engine, the improvement comprises said distributor is provided with an air vent portion having a magnetic trap means. Any dust carried in air drawn into the distributor from the outside for ventilation purposes will not penetrate to the interior but will be caught by the magnetic trap means.

BRIEF DESCRIPTION OF THE DRAWINGS

These and other objects and advantages of the present invention will be more apparent from the following description and drawings, in which.

DESCRIPTION OF THE PREFERRED EMBODIMENTS

Figure 1:
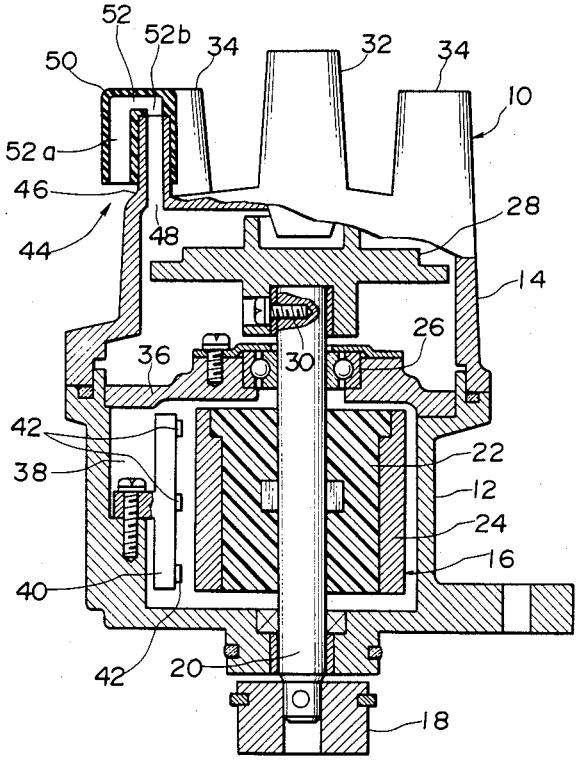
FIG. 1 is an explanatory, partially cutaway view of the distributor according to the present invention.

Embodiments of the present invention will now be described with reference to the accompanying drawings. With reference to the embodiment shown in FIG. 1, the numeral 10 denotes a distributor; a housing 12 and a distributor cap 14 that is fitted onto the upper part of the housing 12 form the casing of the distributor 10.

A magnetic rotating member 16 which is rotatably accommodated inside the distributor is comprised of a ferrite magnetic ring 24 affixed coaxially to a shaft 20 by means of a thermosetting resin 22 such as a phenol resin or the like, the said shaft 20 being coupled via a joint 18 to a camshaft (not shown) which rotates synchronously with the rotation of a crankshaft (not shown) of an internal combustion engine at one half the revolutions thereof. The rotating member 16 is supported by a bearing 26 inside the distributor 10 so as to be freely rotatable, and has at the upper end thereof a rotor 28 affixed thereto by a screw 30. On the upper part of the distributor cap 14 are formed a center electrode portion 32 and a number of outer electrode portions 34 that corresponds to the number of cylinders in the internal combustion engine. In the case of the present embodiment, a 4-cylinder engine is assumed, so there are four such portions.

Figure 2:
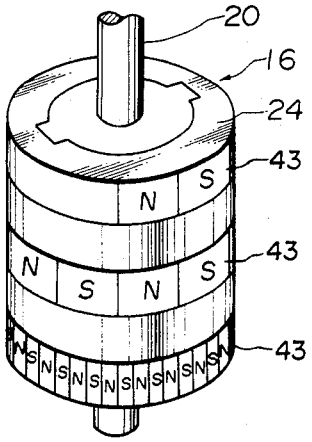
FIG. 2 is an explanatory perspective view of the magnetic rotating member accommodated within the distributor.

The magnetic ring 24 is rotatably located in a chamber 38 formed by a partition 36. A sensor board 40 in the chamber 38 which is separated from the outer peripheral surface of the magnetic ring 24 by a prescribed distance is fixed to the housing 12 by means of screws. The sensor board 40 is provided with three magneto electric transducer means 42 such as Hall elements which are arranged in opposition to magnetized zones formed on the magnetic ring. As shown in the detailed view of FIG. 2, the magnetic ring 24 used to form the rotating member 16 is tubular in shape, and formed on the periphery thereof are three magnetized zones 43.

Although the present invention employs a magnetic ring as the magnetic rotating member, the gist of this invention does not reside in the said magnetic rotating member per se, and as such the magnetic rotating member may be formed according to the conventional art, as laminations of disk-shaped magnets.

A characterizing feature of the present invention is the provision of an air vent and a magnetic trap in the distributor housing the magnetic rotating member. This point will now be explained. An air vent 44 is formed on the upper part of the distributor cap 14. This air vent 44 is comprised of a projecting portion 46 which projects up alongside the outer electrode portions 34, and a vent passage 48 which passes through the interior of the projecting portion 46. A cap 50 fits over the projecting portion. For maximum prevention of entry of foreign matter such as water and the like that falls down from above, the cap 50 is M-shaped so that the vent opening faces downward, and an air passage 52 is provided therein. The air passage 52 consists of an outer air passage 52*a* which opens downward to the atmosphere and an inner air passage 52*b*, joined to the outer air passage 52*a*, which goes down toward the interior of the distributor, the construction being arranged so that the projecting portion 46 inserts into the inner air passage 52*b*. The cap 50 is made of magnetic rubbery material. Because the cap 50 is made of a resilient material, it is easy to fit it into position, and as the entire cap is magnetized, even if any metal or such like dust or foreign matter entrained in air drawn into the distributor from the outside for ventilation purposes will not enters the air passage, instead of penetrating to the vent passage 48, it will be drawn onto the wall of the said air passage, thus preventing the problem of dust entering into the distributor and adhering to the magnetic ring 24, thereby avoiding occurrence of adverse changes in the magnetic characteristics of the magnetic ring 24.

Figure 3:
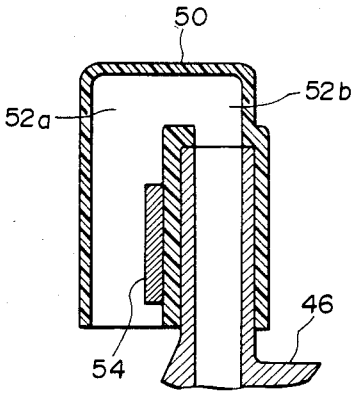
FIG. 3 is an partial explanatory cross-sectional view of another embodiment of the distributor according to this invention.

FIG. 3 shows a second embodiment of the distributor according to this invention, in which the cap 50 is fabricated from an ordinary resin or the like, instead of the magnetic rubber, and a small magnet 54 is attached to the outer air passage 52*a*. Thus, dust and so forth coming in from the outside does not penetrate to the interior of the distributor but is instead collected by the small magnet. Also, as the small magnet 54 is attached to the outer air passage 52*a*, any dust falling from the magnet will not enter the distributor, thereby enhancing the protection against the entry of dust and the like. In addition, the arrangement is such that even if the magnet itself should come off the cap, it would not fall into the distributor.

As described in the foregoing, the present invention provides a distributor having an air vent portion which is provided with a magnetic trap means, so that dust and the like carried in air drawn into the distributor from the outside for ventilation purposes will be caught by the magnetic trap means, instead of penetrating to the interior of the distributor and adhering to the magnetic rotating member of the sensor housed therein, which would have an adverse effect on the magnetic characteristics of the rotating member.

While the above description discloses preferred embodiments of the invention, it is to be understood that numerous modifications or alteration may be made without departing from the scope of the invention as set forth in the following claims.

What is claimed is:

1. A distributor in which is accomodated is a magnetic rotating member which rotates in synchronization with the rotation of the crankshaft of an internal combustion engine, the improvement comprises:

said distributor is provided with an air vent portion having a magnetic trap means.

2. The distributor according to claim 1 wherein said air vent portion is comprised of an air vent which projects up from the casing of the distributor and a cap which fits over the air vent and within which is provided an air passage, said cap being formed of magnetic rubbery material.

3. The distributor according to claim 1 wherein said air vent portion is comprised of an air vent which projects up from the casing of the distributor and a cap which fits over the air vent and within which is provided an air passage, the air passage of said cap having a small magnet attached thereto.

4. The distributor according to claim 3 wherein said small magnet is attached to the outer air end of said air passage of the cap.

* * * * *